United States Patent [19]

Savigny

[11] 4,010,540

[45] Mar. 8, 1977

[54] METHOD OF CONNECTING ELECTRICAL CONDUCTORS AND CONNECTIONS OBTAINED THEREBY

[75] Inventor: Andre Savigny, Eaubonne, France

[73] Assignee: Societe de Vente de l'Aluminium Pechiney, Paris, France

[22] Filed: June 30, 1975

[21] Appl. No.: 591,869

[30] Foreign Application Priority Data

July 25, 1974 France ..... 74.25823

[52] U.S. Cl. ..... 29/630 A; 29/628; 339/276 R

[51] Int. Cl.[2] ..... H01R 9/14

[58] Field of Search ..... 29/630 A, 628; 339/276 R, 276 T; 287/79; 174/84 C, 94 R

[56] References Cited

UNITED STATES PATENTS 2,999,703 9/1961 Myers ..... 29/509 X 3,500,296 3/1970 O'Keefe et al. ..... 29/630 A X

FOREIGN PATENTS OR APPLICATIONS 533,031 11/1956 Canada ..... 339/276 R 1,116,728 2/1956 France ..... 339/276 R

*Primary Examiner*—Victor A. DiPalma

*Attorney, Agent, or Firm*—Dennison, Dennison, Meserole & Pollack

[57] ABSTRACT

A method of connecting electrical conductors and the connection obtained thereby wherein the extremity of a conductor is received within a sleeve which is in turn selectively inwardly deformed by lost punches which are initially aligned with the exterior of the sleeve and are driven inwardly to deform the aligned area of the sleeve into locking engagement with the flattened conductor, the punch itself locking within the sleeve.

3 Claims, 5 Drawing Figures

METHOD OF CONNECTING ELECTRICAL CONDUCTORS AND CONNECTIONS OBTAINED THEREBY

The invention is concerned with the securing of electrical cables and conductors.

It is known that conductors can be connected by means of connections comprising at least one metallic sleeve into which the end of the conductor to be connected is introduced, the conductor being secured in the sleeve by driving in one or more punches adapted in size to the cross-section of the cable to be connected. The punch is generally frustoconical in shape, the generatrix of the frustum being either a straight line or a broken line, more especially a stepped line. In the first case, a smooth lateral surface is obtained for the punch whilst, in the second case, a stepped lateral surface is obtained.

When low-tension cables are connected, the cavities formed by the punches are left as they stand. In the case of higher voltages and, more especially, in the case of 20 kilovolt cables, the impressions left by the punches are filled with a special mastic, because the connections are subsequently embedded in an insulating material, and it is important to avoid any air pockets which could result in degradation of the insulating material under the effect of electrical fields.

This filling operation is difficult and time-consuming and requires skilled personnel.

The present invention relates to a method of joining electrical conductors by means of a connection comprising at least one sleeve into which at least one punch is driven, which obviates this disadvantage.

The invention also relates to the connections obtained by carrying out this method.

In the method according to the invention, the punch is lost, remaining embedded in the sleeve.

The connection according to the invention comprises at least one sleeve in which the end of a conductor to be connected is engaged, and punches lost in this sleeve.

The invention thus defined is described in the following with reference to one particular embodiment illustrated in the accompanying drawings, wherein:

FIGS. 1 and 2 are partial views showing the "lost-punch" connection,

FIG. 1 being a side view and

FIG. 2 a section on the line II of FIG. 1.

Figure 1:
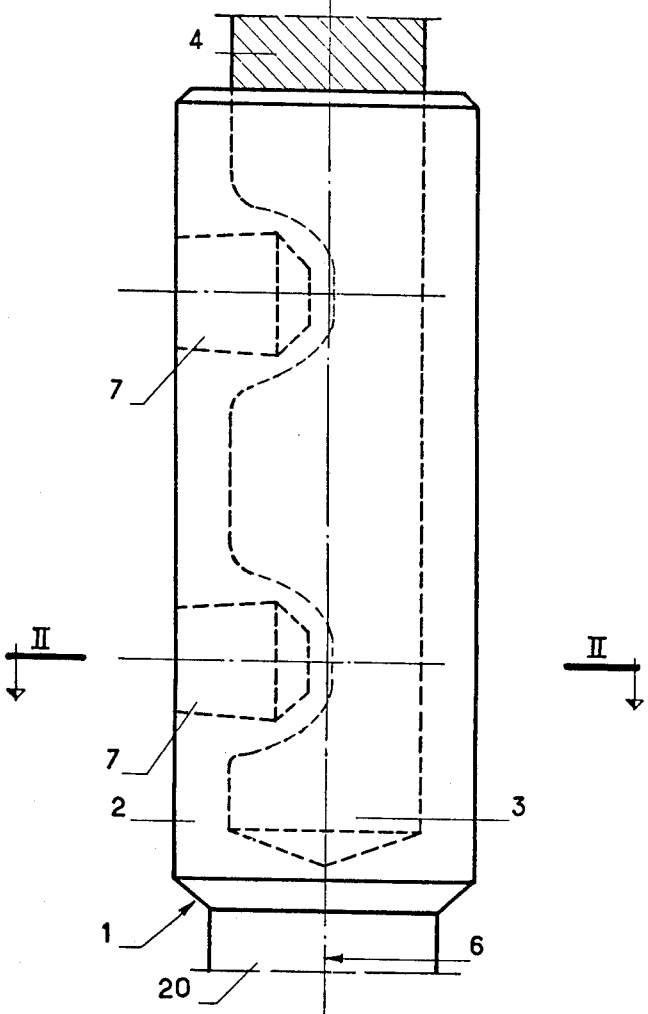
Figure 2:
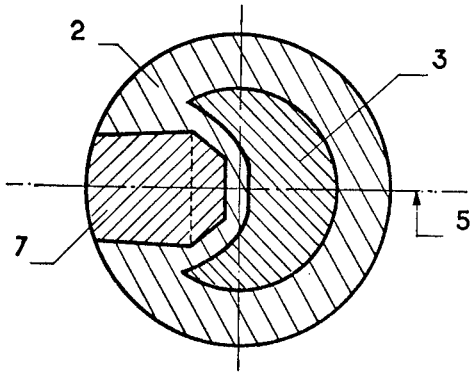
Figure 3:
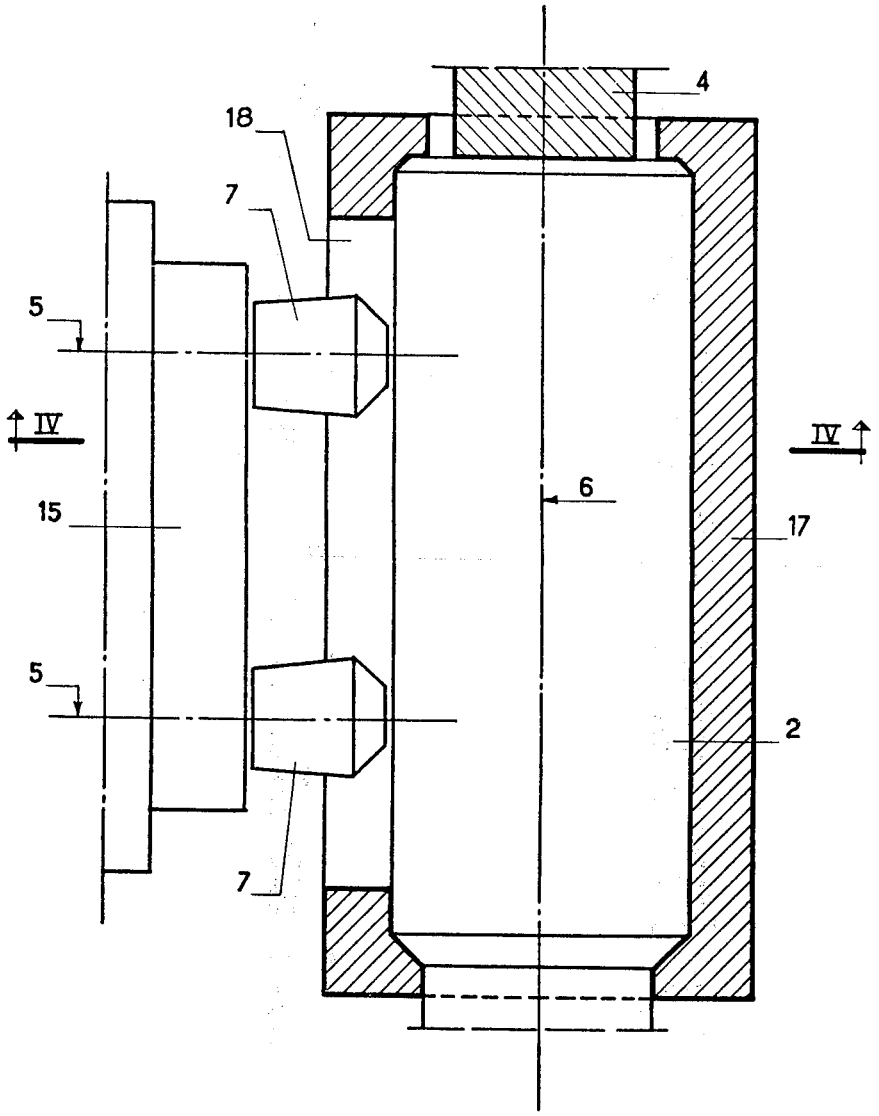
FIGS. 3 and 4 show the same connection during punching, FIG. 4 being a section on the line IV of FIG. 3.

The connection 1 comprises a sleeve 2 in which the end 3 of an electrical conductor 4 is engaged. At least one and, in the embodiment illustrated, two lost punches 7 are introduced into the sleeve 2 in a direction 5 perpendicular to its axis 6. By flattening the conductor, the punches 7 establish a satisfactory mechanical and electrical connection between the conductor 4 and the sleeve 2.

Figure 5:
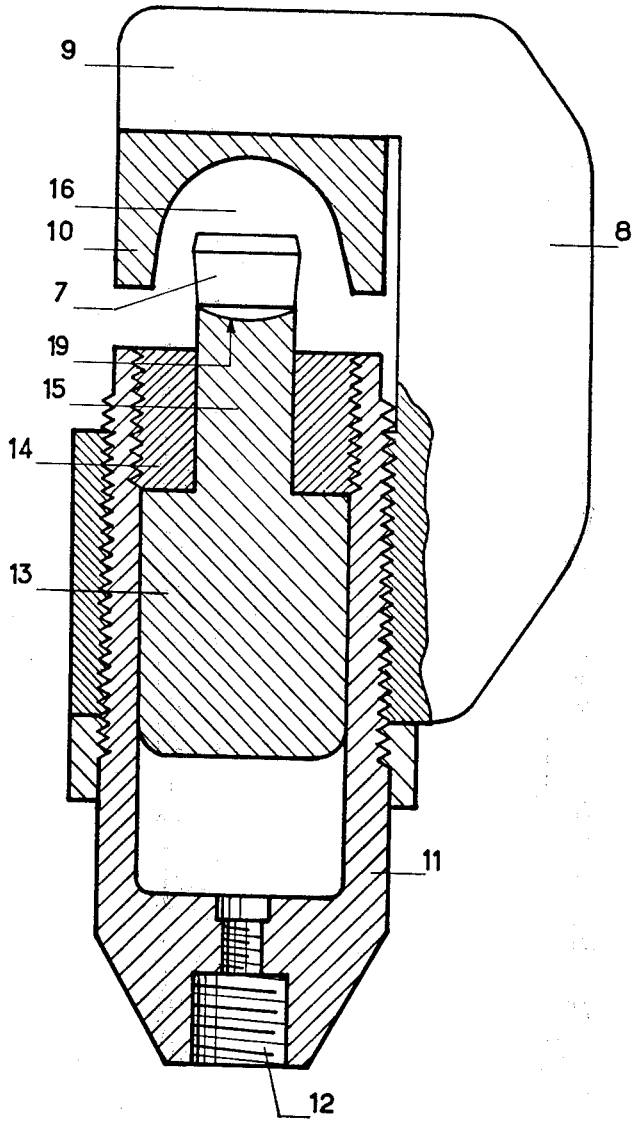
FIG. 5 shows one example of a punching press.

The punching press shown in FIG. 5 comprises a body 8 equipped with a jaw 9 to which may be fixed a cavity block 10 matching the external form of the sleeve 2. The body 8 further comprises a cylinder 11 formed with an inlet 12 for fluid under pressure. A piston 13 may slide in the cylinder 11. This piston comprises a support 15 applied to the punch or punches 7.

Figure 4:
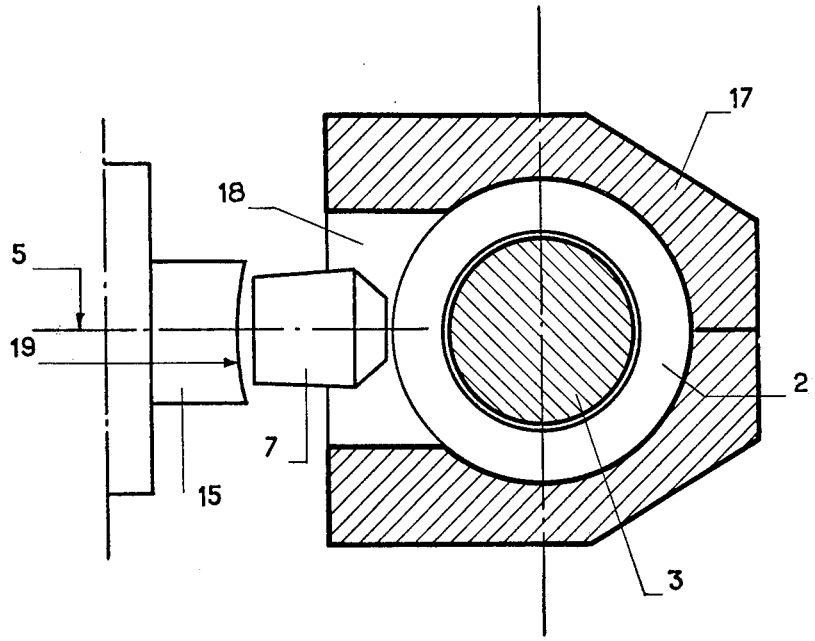

The sleeve 2 may be introduced into the cavity 16 of the block 10 either directly or surrounded by a rigid cover 17 formed with a hole 18 opposite the punches which prevents any deformation of the sleeve outside the punched zone and promotes the wedging of the punches. The stroke of the piston 13 in the cylinder 11 is limited by contact of the shoulder of the support 15 either with an annular stop 14 (FIG. 5) or with the cavity block 10 or cover 17 (FIG. 4).

The punches 7 are held in position on the sleeve 2 either by spot welding or by a retaining means which may consist of, for example, an opening 18 corresponding to the shape of the punch.

It is of advantage to provide the end 19 of the support 15 with a profile corresponding to the shape of the outer wall of the sleeve.

The connection 1 and, hence, the sleeve 2 may consist for example of copper or aluminum. The punches 7 may be made of an aluminum alloy containing approximately 5 percent of zinc or of any sufficiently hard aluminum alloy. To ensure that they will permanently remain in the sleeve, their outer surface may be formed, for example, with at least one undercut slope or may be knurled.

The advantages of the lost punch are, on the one hand, the elimination of the need to fill the cavities formed by conventional removable punches and, on the other hand, the certainty of always using the correct punch because the punch is bound to the sleeve.

The invention may be used for connecting electrical conductors and, more especially, for connecting two or more conductors, the connection comprising as many sleeves 2 as there are conductors to be connected; in cases where it is required to join two conductors situated in the extension one of the other, the connection comprises two sleeves, the second sleeve being symmetrical to the first sleeve 2 relative to a plane 20, as shown in FIG. 1; and for connecting a conductor to a connecting eye, the connecting eye being situated below the plane 20 in FIG. 1 and, finally, for connecting a conductor to a cable end.

I claim:

1. A method of connecting electrical conductors by means of a connection comprising a sleeve, including the steps of; engaging the extremity of a conductor into the sleeve, orientating at least one punch perpendicular to the axis of the sleeve at any point about the exterior thereof, retaining the punch in contact with the exterior of the sleeve at the chosen point about the exterior thereof, and driving the punch perpendicularly through the exterior of the sleeve to effect an inward deformation of the aligned area of the sleeve, a permanent seating of the punch within the sleeve, and a corresponding flattening of the conductor.

2. The method of claim 1 including the step of retaining the punch in contact with the exterior of the sleeve, prior to the driving thereof, by providing a cover means, with a punch receiving hole therein, about said sleeve and positioning said punch within the punch receiving hole and in contact with the sleeve through the cover, said cover preventing deformation of the sleeve outside the area of the punch.

3. The method of claim 1 including the step of retaining the punch by spot welding the leading end thereof to the sleeve.

* * * * *